US007802446B2

(12) United States Patent
Overgaard

(10) Patent No.: US 7,802,446 B2
(45) Date of Patent: Sep. 28, 2010

(54) BOTTLE

(75) Inventor: Erik Overgaard, Oslo (NO)

(73) Assignee: Reactor Spirits Norway Ltd., Sandvika (NO)

( * ) Notice: Subject to any disclaimer, the term of this patent is extended or adjusted under 35 U.S.C. 154(b) by 249 days.

(21) Appl. No.: 11/350,280

(22) Filed: Feb. 9, 2006

(65) Prior Publication Data

US 2006/0191283 A1 Aug. 31, 2006

Related U.S. Application Data

(60) Provisional application No. 60/651,164, filed on Feb. 9, 2005, provisional application No. 60/722,953, filed on Oct. 4, 2005.

(51) Int. Cl.
*F25D 3/08* (2006.01)

(52) U.S. Cl. ..... 62/457.3

(58) Field of Classification Search ..... 62/457.1, 62/457.2, 457.3, 457.4, 457.8, 371, 372, 62/530; 220/23.87, 23.89, 528, 62.12, 592.16; 222/566; 165/902, 10, 918
See application file for complete search history.

(56) References Cited

U.S. PATENT DOCUMENTS

| | | | | |
|---|---|---|---|---|
| 303,003 | A | 9/1884 | Doolitle | |
| 415,980 | A | 11/1889 | Sachs | |
| 662,541 | A | 11/1900 | Miskolczy | |
| 929,398 | A | 7/1909 | Cryer | |
| 1,519,034 | A | 12/1924 | Liviingston | |
| 1,594,015 | A | 7/1926 | McLaughlin | |
| 1,858,728 | A | 5/1932 | Chreighton | |
| 2,746,265 | A | 5/1956 | Mills | |
| 2,876,634 | A | 3/1959 | Zimmerman et al. | |
| 3,283,530 | A | 11/1966 | Bayne et al. | |
| 4,170,320 | A | 10/1979 | Eagar | |
| 5,001,907 | A | 3/1991 | La Croix et al. | |
| 5,005,374 | A | 4/1991 | Spitler | |
| 5,044,173 | A | 9/1991 | Cheng | |
| 5,148,682 | A | 9/1992 | Wolf | |
| 5,177,981 | A * | 1/1993 | Haas | 62/457.3 |
| 5,406,808 | A * | 4/1995 | Babb et al. | 62/457.4 |
| 5,467,877 | A * | 11/1995 | Smith | 215/11.1 |
| 5,520,103 | A * | 5/1996 | Zielinski et al. | 99/483 |
| 5,609,039 | A * | 3/1997 | Green et al. | 62/457.3 |
| 5,799,501 | A | 9/1998 | Leonard et al. | |
| 5,950,450 | A * | 9/1999 | Meyer et al. | 62/457.9 |
| 6,128,906 | A | 10/2000 | Sillince | |
| 6,128,915 | A | 10/2000 | Wagner | |
| 6,324,864 | B1 | 12/2001 | Stewart et al. | |
| 6,415,624 | B1 | 7/2002 | Connors et al. | |
| 6,442,961 | B1 * | 9/2002 | Rosenberg et al. | 62/457.3 |
| 6,482,332 | B1 | 11/2002 | Malach | |
| 6,494,056 | B1 | 12/2002 | Roth et al. | |

(Continued)

FOREIGN PATENT DOCUMENTS

DE 299 08 927 U 1 10/1999

(Continued)

*Primary Examiner*—Mohammad M Ali
(74) *Attorney, Agent, or Firm*—Sherr & Vaughn, PLLC

(57) ABSTRACT

A temperature regulating mechanism is attached inside the bottle. The temperature regulating mechanism may include phase change material. The temperature regulating mechanism may maintain a liquid (e.g. Vodka) stored in the bottle at a substantially consistent temperature (e.g. approximately 10 degrees Celsius) for a reasonable period of time.

12 Claims, 2 Drawing Sheets

U.S. PATENT DOCUMENTS

| | | | | |
|---|---|---|---|---|
| 6,584,800 | B1 | 7/2003 | Roth et al. | |
| 6,622,516 | B1 * | 9/2003 | Horen | 62/457.4 |
| 6,622,878 | B1 * | 9/2003 | Frey | 215/12.2 |
| 6,634,417 | B1 | 10/2003 | Kolowich | |
| 6,751,982 | B2 * | 6/2004 | Horen | 62/457.4 |
| 6,789,693 | B2 * | 9/2004 | Lassiter | 220/592.18 |
| 6,875,486 | B2 * | 4/2005 | Miller | 428/34.1 |
| 6,931,885 | B2 | 8/2005 | Citrynell et al. | |
| 7,082,784 | B2 * | 8/2006 | Roth et al. | 62/457.2 |
| 7,134,564 | B2 * | 11/2006 | Verbovszky | 215/11.4 |
| 2001/0019731 | A1 * | 9/2001 | Shindo | 426/11 |
| 2002/0005044 | A1 | 1/2002 | Mahajan | |
| 2002/0095947 | A1 | 7/2002 | Treppedi et al. | |
| 2003/0002385 | A1 * | 1/2003 | Pola et al. | 366/130 |
| 2003/0029187 | A1 | 2/2003 | Mills et al. | |
| 2003/0041618 | A1 | 3/2003 | Holley, Jr. | |
| 2003/0222100 | A1 | 12/2003 | Husband et al. | |
| 2004/0123620 | A1 | 7/2004 | Porter | |
| 2004/0182106 | A1 | 9/2004 | Citrynell et al. | |
| 2005/0029299 | A1 | 2/2005 | Switzer | |
| 2005/0229626 | A1 | 10/2005 | Akopyan | |
| 2006/0156756 | A1 * | 7/2006 | Becke | 62/457.3 |
| 2006/0162374 | A1 | 7/2006 | Ganser | |
| 2008/0087674 | A1 | 4/2008 | Overgaard | |
| 2008/0087682 | A1 | 4/2008 | Overgaard | |
| 2008/0230508 | A1 | 9/2008 | Overgaard | |
| 2008/0308563 | A1 | 12/2008 | Overgaard | |

FOREIGN PATENT DOCUMENTS

| | | | |
|---|---|---|---|
| FR | 2 708 910 | A1 | 2/1995 |
| FR | 2 840 061 | A1 | 11/2003 |
| SU | 1652770 | | 12/1989 |

* cited by examiner

BOTTLE

Priority is claimed to U.S. Provisional Patent Application No. 60/651,164 (filed in the U.S. Patent and Trademark Office on Feb. 9, 2005) and U.S. Provisional Patent Application No. 60/722,953 (filed in the U.S. Patent and Trademark Office on Oct. 4, 2005), which are all herein incorporated by reference in entirety.

BACKGROUND

Beverages are an important part of the lives of all humans. Since the beginning of the human race, humans have been consuming beverages (e.g. water, juices, and alcohol) for sustenance and enjoyment. Over time, beverages have been crafted and developed tailored to the tastes and nutritional requirements of a given society. Along with the development of beverages, consumption habits and preferences have been cultivated specific to different beverages. For example, the alcoholic beverage Vodka was developed in Northern and Eastern Europe over more than a thousand years. Many varieties of Vodka are consumed at a relatively cold temperature. In fact, may Vodkas must be consumed at around 10 degrees Celsius in order for the consumer to enjoy the full taste of the spirit and aroma. It can be difficult in a social setting (e.g. a drinking establishment such as a bar) to maintain Vodka (and other beverages) at its ideal serving temperature for a reasonable amount of time. For example, if a group of patrons at a bar purchase a bottle of Vodka to be enjoyed over a couple of hours at their table, it may be difficult for the patrons to enjoy the full taste of the Vodka due to their inability to maintain the Vodka in the bottle at the critical temperature of 10 degrees Celsius.

SUMMARY

Embodiments relate to an apparatus comprising a bottle and a temperature regulating mechanism attached inside the bottle. The temperature regulating mechanism may include phase change material. In embodiments the temperature regulating mechanism can maintain Vodka in the bottle at approximately 10 degrees Celsius. For example, if a group of patrons at a bar purchased a bottle of Vodka with a temperature regulating mechanism, they would be able to enjoy the full taste of the spirit and aroma over a couple of hours, since the Vodka could be maintained at approximately 10 degrees Celsius.

Embodiments relate to a bottle, a pouring mechanism, and a bottle cap. The pouring mechanism may include a drop cut spout. The bottle cap may be shaped complementary to the drop cut spout and may include a flexible plug. The flexible plug may fixedly and removably engage with the pouring mechanism at an opening of the pouring mechanism. Embodiments relate to a bottle and a silk screen label attached to the outside of the bottle.

DRAWINGS

DESCRIPTION

Figure 1:
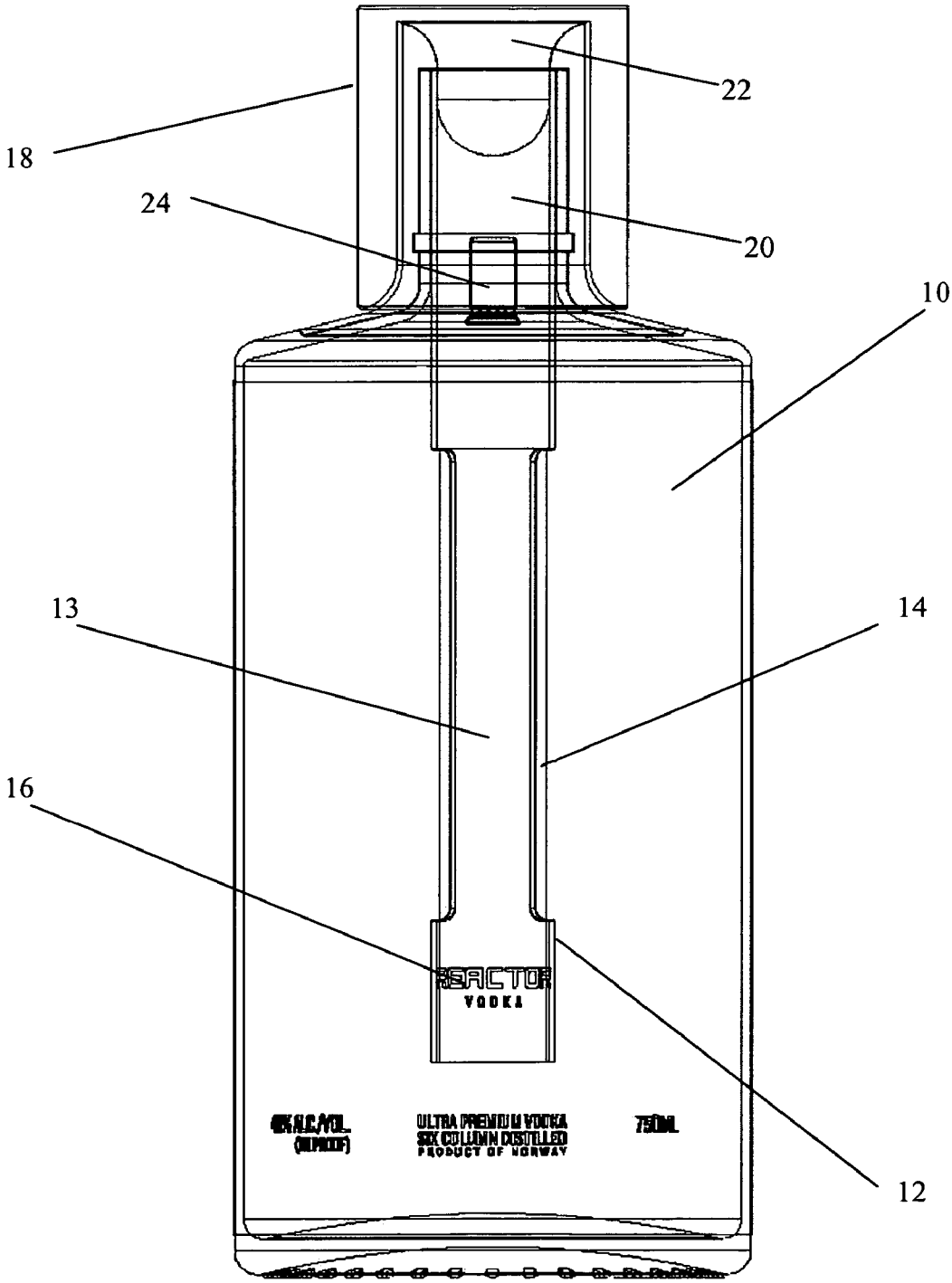
FIG. 1 illustrates an example cross-sectional view of a bottle and a temperature regulating mechanism attached inside the bottle.

FIG. 1 illustrates an example cross-sectional view of a bottle 10 and a temperature regulating mechanism 12 attached inside the bottle 10, in accordance with embodiments. In embodiments, the temperature regulating mechanism 12 may maintain liquid inside the bottle 10 at a predetermined temperature (e.g. below room temperature). Liquid inside bottle 10 may be spirits (e.g. Vodka), wine, beer, or non-alcoholic beverage.

In embodiments, the temperature regulating mechanism 12 is rigidly attached inside the bottle 10. However, one of ordinary skill in the art would appreciate that a temperature regulating mechanism could be attached to a bottle non-rigidly.

The temperature regulating mechanism 12 may include phase change material. Phase change material is a class of materials that use phase changes (e.g. melting or freezing) to absorb or release relatively large amounts of latent heat at relatively constant temperatures. Phase change material is disclosed in U.S. Pat. No. 6,574,971 to Suppes, which is hereby incorporated by reference in its entirety. Phase change materials allow for a micro encapsulation and a customized melt/freeze point. When the temperature becomes warmer than the freeze point, phase change materials liquefy and absorb and store heat. Conversely, when the temperature drops, the material will solidify and give off heat, warming the material coated or impregnated with phase change material.

Phase change materials are used for a wide range of applications in the industry, and are far superior to and comparable with ordinary ice or freeze gel for many applications. For example, the U.S. army uses a cold vest filled with a phase change material to keep soldiers cool in hot conditions; the material interacts with body heath. Phase change material may be used as an insulator for Pizza delivery packaging to keep the pizza hot during transport. It may be used in air conditioning devices to accumulate cold in order to save electricity consumption.

In embodiments, phase change material maintains alcohol (e.g. vodka) in a bottle between about at approximately 10° C. In embodiments, a liquid can be maintained at a prescribed temperature that is specifically tailored for the ideal temperature of the liquid. Phase change material used may be non-toxic and may be made out of food grade materials such as soy. Phase change material may be used for temperature moderation of vodka, and may be formulated to interact with the aroma flavor's ideal serving temperature at approximately 10° C. In embodiments, phase change material is tailored to have a melting and freezing point of approximately 10° C. In other words, at approximately 10° C. or below, the phase change material will be frozen and temperatures above approximately 10° C. the phase change material will be a liquid. When the phast change material is a solid and starts to melt to become a liquid, it may absorb large amounts of heat from its surroundings and thereby keep it cooler. Conversely when phase change material starts to go from a solid state to a liquid state it will release large amounts of heat and therefore aids in alcohol from getting too cold too quickly. It is the actual process of melting and freezing of phase change material that assists in temperature moderation.

In embodiments, a temperature regulating mechanism 12 than includes phase change material may be rigidly attached inside a bottle 10 at a location proximate to the opening of the bottle 10. The temperature regulating mechanism may maintain liquid (e.g. Vodka) inside the bottle 10 at a predetermined temperature (e.g. approximately 10° C.). Phase change material of the temperature regulating mechanism 12 may interact with and absorb the temperature from liquid inside the bottle 10 through a physical reaction associated with phase change material. For example, when a bottle 10 containing including phase change material is chilled at temperatures below the freezing point of the phase change material (e.g. 10° C. for a temperature regulating mechanism in a Vodka bottle), phase change material will solidify. When a bottle 10 is taken out of the chilled environment, phase change material may absorb extra heat from its surroundings. The heat is absorbed and stored in the phase change material and not in the liquid. This may assist in keeping liquid chilled at a prescribed temperature (e.g. an ideal serving temperature of approximately 10° C. for Vodka).

In embodiments, a temperature regulating mechanism 12 including phase change material may act as a temperature control device for temperature maintenance and moderation of liquid (e.g. Vodka or other beverage) inside bottle 10. For example, in the case of Vodka, a temperature regulating mechanism 12 may keep and maintain Vodka for a prolonged period of time (e.g. 1.5 hours) at an ideal serving temperature at which the unique aroma comes in full blossom. A temperature regulating mechanism 12 may also liquid inside bottle 10 from cooling down too fast. For example, low quality Vodkas sometimes mask their aroma and/or quality by over-cooling the Vodka. In the case of higher quality Vodkas, too cold a serving temperature may be undesirable as it would numb several of the aroma extracts and prevent the optimal taste experience of the formulation.

In embodiments, the temperature regulating mechanism 12 may be an elongated member and/or may have the approximate shape of a cylinder. However, one of ordinary skill in the art would appreciate other shapes and dimensions without departing from the spirit of embodiments. In embodiments, temperature regulating mechanism 12 includes at least one pouring hole 24 to facilitate liquid inside the bottle 10 to be poured through the opening of bottle 10.

Temperature regulating mechanism 12 may include at least one phase change unit 14 and a sheath 13. Each of the at least one phase change unit 14 may include an enclosure to prevent mixing of phase change material with liquid (e.g. Vodka) in the bottle 10. Sheath 13 may surround the at least one phase change material unit and may maintain the position of the at least one phase change unit 14 inside bottle 10. Sheath 13 may have at least one opening, which may expose the at least one phase change material unit 14 to liquid inside bottle 10. Insignia (e.g. branding, attributes of liquid in bottle 10) may be viewable from outside the bottle 10 on sheath 13.

An at least one opening in sheath 13 may display the appearance through the bottle of phase change material of the temperature regulating mechanism 12, in accordance with embodiments. The appearance of the phase change material may indicate if the temperature of liquid (e.g. Vodka) is at an predetermined set temperature (e.g. the ideal serving temperature of approximately 10° C. for Vodka). In embodiments, the appearance of the phase change material may be discriminated by the level of transparency and/or the color of the phase change material. The level of transparency and/or color of the phase change material may be a result of the phase change material transitioning from a liquid state to a solid state. For example, when the liquid in bottle 10 is maintained at a predetermine temperature (e.g. approximately 10° C. for Vodka), the phase change material is in a solid state. Likewise, the phase change material may change color when it transitions from a liquid state to a solid state, indicating that the liquid (e.g. Vodka) is at a predetermined temperature. The predetermined temperature is reflected in the chemistry of the phase change material, which is tailored for a specific application (e.g. Vodka consumption at approximately 10° C.) of the liquid.

Figure 2:
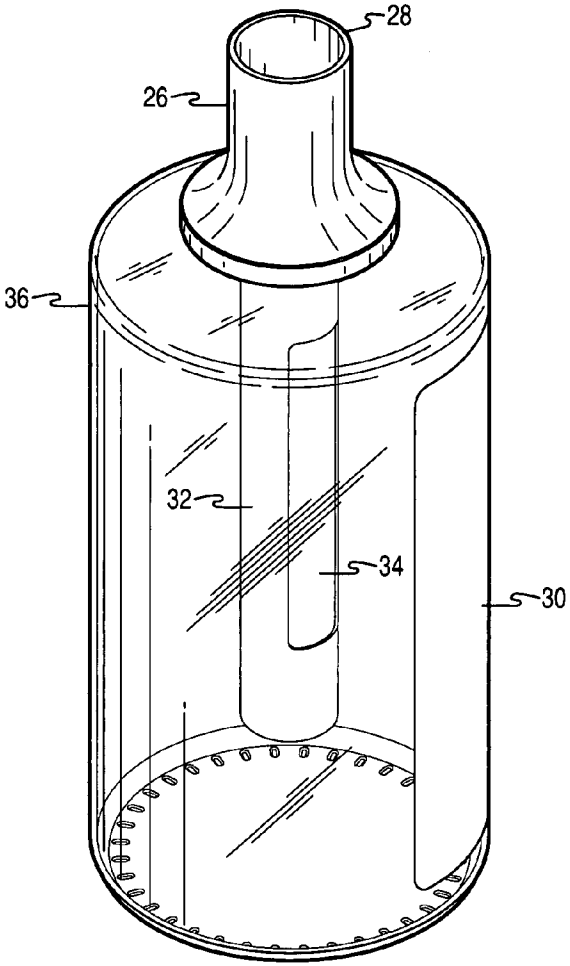
FIG. 2 illustrates an example bottle with a temperature regulating mechanism, a silk screen label, and a drop cut spout at an oblique exterior view.

FIG. 2 illustrates bottle 36 with a temperature regulating mechanism 32, a silk screen label 30, and a drop cut spout 26 at an oblique exterior view. Embodiments relate to a pouring mechanism that includes a drop cut spout 26. In embodiments, the drop cut spout 26 is substantially smooth with an acute edge 28 at the opening of the drop cut spout 26. The acute edge 28 provides for convenient and accurate pouring of liquid from bottle 36.

Figure 3:
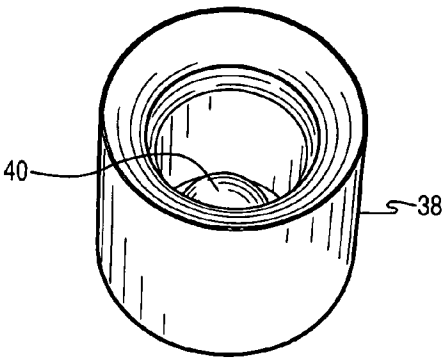
FIG. 3 illustrates an example bottle cap with a flexible plug.

FIG. 3 illustrates bottle cap 38 with a flexible plug 40. Bottle cap 38 is shaped complementary to drop cut spout 26. Bottle cap 38 includes a flexible plug 40 with fixedly and removably engages with drop cut spout 26. When bottle cap 38 is attached to drop cut spout 26, bottle 36 is sealed. Bottle cap 38 can be attached to bottle 36 by applying appropriate pressures, thus deforming flexible plug 40 and applying resistance inside drop cut spout 26 to secure the liquid inside bottle 36. Bottle cap 38 may also serve as a shot glass.

Silk screen label 30 may be attached to the outside of bottle 36 in accordance with embodiments. The silk screen label 30 may make a temperature regulating mechanism 32 and temperature regulating unit 34 more visible from outside bottle 36. Accordingly, the appearance of phase change material in the temperature regulating mechanism may be more easily assessed, which may indicate the approximate temperature of liquid inside bottle 36. Silk screen label 30 may be used to show insignia inside and outside of bottle 36.

The foregoing embodiments (e.g. a bottle and a temperature regulating mechanism) and advantages are merely examples and are not to be construed as limiting the appended claims. The above teachings can be applied to other apparatuses and methods, as would be appreciated by one of ordinary skill in the art. Many alternatives, modifications, and variations will be apparent to those skilled in the art.

What is claimed is:

1. An apparatus comprising:

a container configured to house vodka; and a temperature regulating mechanism attached inside the container, wherein the temperature regulating mechanism comprises an elongated member with an approximate shape of a cylinder and comprises phase change material, the phase change material configured to allow for micro encapsulation and for a customized melt/freeze point at which the phase change material changes phase, wherein the temperature regulating mechanism is configured to maintain the vodka at a predetermined temperature below room temperature at approximately 10 degrees Celsius and for approximately 1.5 hours throughout a forward phase change and a reverse phase change of the phase change material inside the container, wherein the forward phase change comprises a change from a first phase to a second phase, wherein the reverse phase change comprises a change from the second phase to the first phase, wherein either the first phase is a liquid phase and the second phase is a solid phase or the first phase is a solid phase and the second phase is a liquid phase, wherein the forward phase change and the reverse phase change occurs at approximately the predetermined temperature.

2. The apparatus of claim 1, wherein the temperature regulating mechanism is rigidly attached inside the container proximate to an opening of the container.

3. The apparatus of claim 1, wherein the temperature regulating mechanism comprises:

at least one phase change material unit, wherein each of the at least one phase change material unit comprises an enclosure configured to prevent mixing of the phase change material with the vodka; and a sheath which surrounds the at least one phase change material unit, wherein the sheath is configured to maintain the position of the at least one phase change material unit inside the container.

4. The apparatus of claim 3, wherein the sheath comprises at least one opening.

5. The apparatus of claim 4, wherein the at least one opening is configured to directly expose the at least one phase change material unit to the vodka.

6. The apparatus of claim 4, wherein the at least one opening is configured to display the appearance of the phase change material through container.

7. The apparatus of claim 6, wherein:

the appearance of the phase change material indicates if the temperature of the vodka is at an ideal serving temperature; and the temperature regulating mechanism is configured to maintain the vodka at approximately the ideal serving temperature.

8. The apparatus of claim 7, wherein the ideal serving temperature is approximately 10 degrees Celsius.

9. The apparatus of claim 7, wherein the melting point of the phase change material is approximately the ideal serving temperature of the beverage.

10. The apparatus of claim 7, wherein the appearance of the phase change material can be discriminated by at least one of level of transparency and color of the phase change material.

11. The apparatus of claim 3, wherein the sheath comprises insignia viewable from the outside of the container.

12. The apparatus of claim 1, wherein the container is a bottle.

* * * * *